US012135028B2

(12) United States Patent
Krauth et al.

(10) Patent No.: US 12,135,028 B2
(45) Date of Patent: Nov. 5, 2024

(54) SCROLL COMPRESSOR AND METHOD FOR OPERATING THE SCROLL COMPRESSOR

(71) Applicant: Robert Bosch GmbH, Stuttgart (DE)

(72) Inventors: Wolfgang Krauth, Achern-Sasbachried (DE); Juri Hartmann, Huegelsheim (DE); Torsten Wilharm, Rheinau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/555,926

(22) PCT Filed: Apr. 13, 2022

(86) PCT No.: PCT/EP2022/059848
§ 371 (c)(1),
(2) Date: Oct. 18, 2023

(87) PCT Pub. No.: WO2022/223385
PCT Pub. Date: Oct. 27, 2022

(65) Prior Publication Data

US 2024/0218875 A1 Jul. 4, 2024

(30) Foreign Application Priority Data

Apr. 19, 2021 (DE) ..... 10 2021 203 857.3

(51) Int. Cl.
*F04C 18/02* (2006.01)
*F01C 1/02* (2006.01)
*F04C 29/00* (2006.01)

(52) U.S. Cl.
CPC ..... *F04C 18/0215* (2013.01); *F04C 29/0064* (2013.01); *F04C 29/0085* (2013.01); *F04C 2240/40* (2013.01)

(58) Field of Classification Search
CPC .. F04C 18/0215; F04C 18/02; F04C 29/0085; F04C 29/0064; F01C 1/02
See application file for complete search history.

(56) References Cited

U.S. PATENT DOCUMENTS 5,791,883 A 8/1998 Ban et al.
2009/0180909 A1 7/2009 Schofield et al.
(Continued)

FOREIGN PATENT DOCUMENTS

DE 4016693 A1 11/1990
DE 102013020763 A1 6/2015
(Continued)

OTHER PUBLICATIONS

Translation of International Search Report for Application No. PCT/EP2022/059848 dated Aug. 8, 2022 (2 pages).

*Primary Examiner* — Deming Wan
(74) *Attorney, Agent, or Firm* — Michael Best & Friedrich LLP

(57) ABSTRACT

The invention relates to a scroll compressor (10) and to a method for operating the scroll compressor (10). The scroll compressor (10) has a stator (15), an orbiter (20) which can be moved about an orbiter axis (55) relative to the stator (15), and a coupling device (50). The stator (15) and the orbiter (20) engage into each other and at least partly delimit at least one working area (105) for compressing a fluid (110) which can be filled into the working area (105). The coupling device (50) has a first coupling unit (60) which is arranged on the stator (15) and a second coupling unit (65) which is arranged on the orbiter (20) opposite the first coupling unit (60), wherein the first coupling unit (60) is magnetically coupled to the second coupling unit (65), and the second coupling unit (65) introduces a coupling torque ($M_K$) which acts about the orbiter axis (55) into the orbiter (20).

11 Claims, 4 Drawing Sheets

(56) References Cited

U.S. PATENT DOCUMENTS

| | | | | |
|---|---|---|---|---|
| 2017/0051741 | A1* | 2/2017 | Shaffer | F01C 17/063 |
| 2017/0268514 | A1* | 9/2017 | Shaffer | F04C 23/001 |
| 2019/0211824 | A1* | 7/2019 | Shaffer | F04C 29/0085 |

FOREIGN PATENT DOCUMENTS

| | | | |
|---|---|---|---|
| DE | 102017102645 | A1 | 8/2018 |
| EP | 3919743 | A1 | 12/2021 |
| JP | S5540220 | A | 3/1980 |
| JP | 2000045967 | A | 2/2000 |

* cited by examiner

SCROLL COMPRESSOR AND METHOD FOR OPERATING THE SCROLL COMPRESSOR

BACKGROUND OF THE INVENTION

The invention relates to a scroll compressor and a method for operating the scroll compressor.

A scroll compressor is known from DE 10 2017 102 645 A1.

SUMMARY OF THE INVENTION

The object of the invention to provide an improved scroll compressor and an improved method for operating the scroll compressor.

An improved scroll compressor can be provided in that the scroll compressor comprises a stator, an orbiter movable about an orbiter axis relative to the stator, and coupling means, the stator and the orbiter engaging into each other and at least partly delimiting a working area for compressing a fluid that can be filled into the working area, wherein the coupling device comprises a first coupling unit arranged on the stator and a second coupling unit arranged on the orbiter opposite the first coupling unit, wherein the first coupling unit is magnetically coupled to the second coupling unit and the second coupling unit introduces a coupling torque acting about the orbiter axis into the orbiter.

This makes it possible to provide a particularly long-lasting and quiet-running scroll compressor. A drive motor for driving the orbiter can also be selected to be weaker in its design, in particular its maximum torque. In other words, overall the scroll compressor can be manufactured particularly easily and cost-effectively.

In a further embodiment, the scroll compressor comprises a drive motor that is connected to the orbiter in a torque-transmitting manner. The drive motor is designed to provide a drive torque acting about the orbiter axis to drive the orbiter, the drive torque and the coupling torque acting on the orbiter to form a compressor torque. The orbiter is movable from a first position through a second position back to the first position while maintaining a swing direction, the coupling torque acting against the drive torque between the first position of the orbiter and the second position of the orbiter, whereby in the second position the orbiter is swung relative to the first position, and between the second position and the first position of the orbiter the coupling torque and the drive torque are in the same direction. Doing so reduces and smooths an uneven torque curve of the drive torque, especially in the first order. Further, when the drive motor is controlled, a current ripple is reduced in a supply line to the drive motor, which relieves the load on a drive motor for driving the orbiter and on a bearing arrangement for supporting the orbiter.

In another embodiment, a gap is arranged between the first coupling unit and the second coupling unit. Doing so keeps wear on the scroll compressor to a minimum.

In a further embodiment, at least one of the two coupling units has a two-pole permanent magnet or a multipole permanent magnet for forming the magnetic coupling with the other coupling unit. This embodiment has the advantage that the coupling device is particularly compact and requires few components.

In a further embodiment, the first coupling unit or the second coupling unit comprises at least one stack of sheets comprising at least two layers made of a ferromagnetic material and arranged adjacent to one another in a stack. The layers are arranged next to one another in the axial direction with respect to the orbiter axis. This embodiment has the advantage that only low eddy currents are generated in the stack of sheets during operation of the scroll compressor, so that overheating of the coupling unit with the stack of sheets is avoided.

In a further embodiment, the stator has a spiral-shaped first wall and the orbiter has a spiral-shaped second wall, the first wall and the second wall engaging into each other and delimiting the working area at least partly, the first coupling unit being attached to a housing of the stator and the second coupling unit being fastened to a second outer peripheral side of the second wall of the orbiter. It is particularly advantageous if, e.g., the fastening is designed as a bonded connection. The arrangement of the second coupling unit on the second outer peripheral side of the second wall has the further advantage that in this region the second wall does not externally delimit the working area and thus sufficient installation space is available to accommodate the coupling device. Furthermore, an external installation space of the scroll compressor is not increased by accommodating the coupling device on the inside.

In another embodiment, a center of a maximum extension of the first coupling unit in a tangential direction to the orbiter axis is arranged in a plane, wherein the orbiter axis is arranged in the plane.

The scroll compressor described hereinabove can be operated by introducing a fluid into the working area, moving the orbiter about the orbiter axis, and compressing the fluid in the working area, whereby a coupling torque is applied to the orbiter by the magnetic coupling between the first coupling unit and the second coupling unit.

Of particular advantage is when the orbiter is moved from a first position through a second position back to the first position while maintaining a swing direction about the orbiter axis, whereby a drive torque acting about the orbiter axis is provided to the orbiter to drive the orbiter, the drive torque and the coupling torque acting together on the orbiter to form a compressor torque, the coupling torque acting against the drive torque between the first position of the orbiter and the second position of the orbiter, whereby between the second position and the first position the coupling torque and the drive torque are in the same direction.

In a further embodiment, between a first working point and a second working point following the first working point in terms of time, the fluid is compressed in the working area, with the coupling torque acting counter to the drive torque at the first working point at the start of the compression of the fluid. As a result, ripple in the drive torque can be reduced to a particularly high degree.

BRIEF DESCRIPTION OF THE DRAWINGS

The invention is explained in more detail hereinafter with reference to the drawings. Shown are.

DETAILED DESCRIPTION

Figure 1:
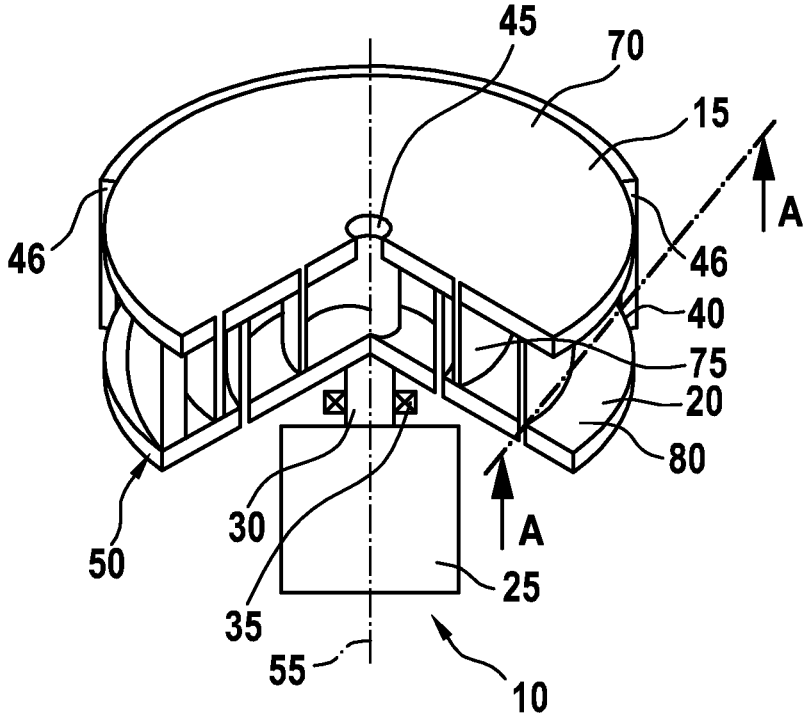
FIG. 1 a schematic representation of a scroll compressor according to a first embodiment.

FIG. 1 shows a schematic representation of a scroll compressor 10 according to a first embodiment.

The scroll compressor 10 comprises a stator 15, an orbiter 20, a drive motor 25, a drive shaft 30, a bearing arrangement 35, an inlet 40, an outlet 45, a housing 46, and a coupling device 50.

The stator 15 is fixed and immovable and is mechanically connected to the housing 46 of the scroll compressor 10. The orbiter 20 is non-rotatably connected to the drive shaft 30, which non-rotatably connects the drive motor 25 to the orbiter 20. The drive shaft 30 is rotatably mounted about an orbiter axis 55. The orbiter 20 is arranged eccentrically to the orbiter axis 55. When the drive motor 25 is activated, the orbiter 20 is guided and swung about the orbiter axis 55. The bearing arrangement 35 is designed to support forces from the orbiter 20 guided eccentrically about the orbiter axis 55.

Figure 2:
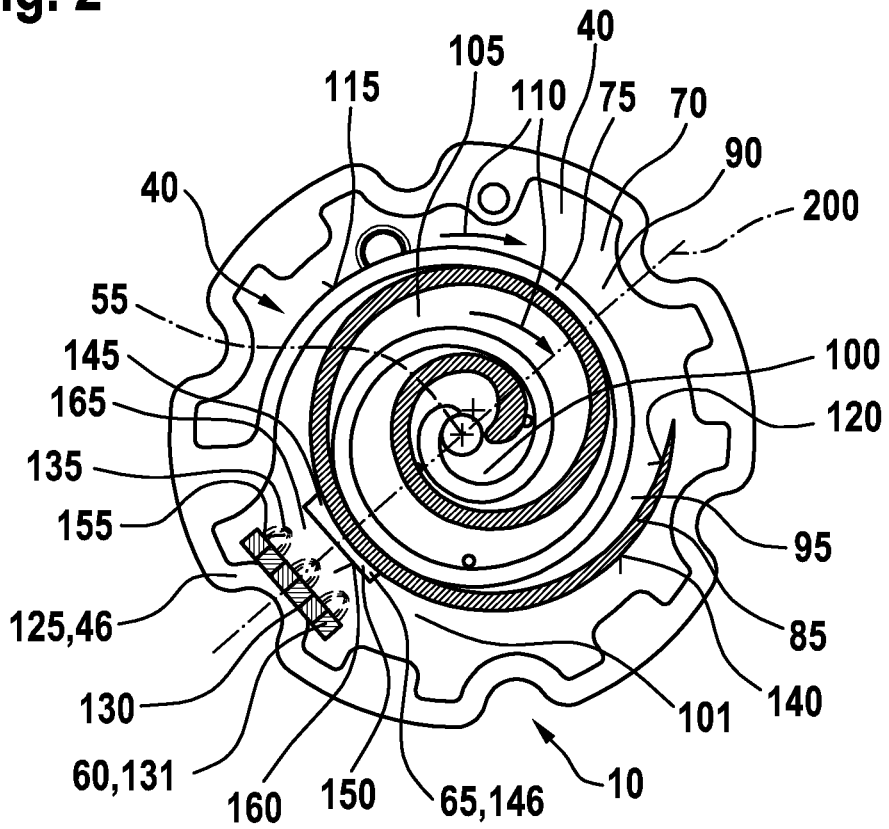
FIG. 2 a sectional view along a sectional plane A-A shown in FIG. 1 through the scroll compressor shown in FIG. 1 in a 0° position.

FIG. 2 shows a sectional view along a sectional plane A-A shown in FIG. 1 through the scroll compressor 10 shown in FIG. 1 in a 0° position.

The stator 15 comprises a first base plate 70 and a first wall 75. The first base plate 70 extends substantially in a plane of rotation perpendicular to the orbiter axis 55. In the axial direction, the first base plate 70 can be arranged opposite the drive motor 25 and is mechanically connected to the housing 46. The first wall 75 leads around the orbiter axis 55 in a spiral shape, is axially arranged on one side on the first base plate 70, and is connected to the first base plate 70. The first base plate 70 and the first wall 75 can be integrally manufactured and consist of a single material, e.g., a non-magnetic material such as aluminum. Radially outward of the first wall 75, the inlet 40 is arranged between the first wall 75 and the first housing 46. The outlet 45 can be arranged in the first base plate 70 in a substantially central position with respect to the orbiter axis 55.

For example, the inlet 40 can be fluidically connected to a refrigerant circuit of a heat pump. A fluid 110, in particular a refrigerant, for example R410, in a preferably gaseous state, can be introduced into the scroll compressor 10 via the inlet 40. The outlet 45 can, e.g., be fluidically connected to a heat exchanger of the heat pump.

The orbiter 20 comprises a second base plate 80 (shown in FIG. 1) and a second wall 85 (see FIG. 2). The second wall 85 leads around the orbiter axis 55 in a spiral shape. The second wall 85 is axially connected to the second base plate 80 at one side. The second base plate 80 is axially offset from the first base plate 70. In this case, the second wall 85 is arranged on the second base plate 80 on an axial side facing the stator 15 and thus on a side facing away from the first base plate 70. Preferably, the second base plate 80 and the second wall 85 are manufactured integrally and made of the same material, e.g., a non-magnetic material such as aluminum.

The first base plate 70 and the second base plate 80 are axially offset from each other. Axially between the first base plate 70 and the second base plate 80, the first wall 75 and the second wall 85 are arranged relative to each other such that the first wall 75 and the second wall 85 engage into each other. Together with the first base plate 70 and the second base plate 80, the first wall 75 and the second wall 85 delimit an inlet region 90, a compressor region 95, an outlet region 100, and a motion area 101. The inlet region 90 is arranged downstream of the inlet 40 and upstream of the compressor region 95. In the compressor region 95, the first wall 75 and the second wall 85 radially delimit at least one working area 105. Preferably, the first and second walls 75, 85 delimit a plurality of working spaces 105 arranged separately from each other in the circumferential direction with respect to the orbiter axis 55. On the downstream side, the compressor region 95 is followed by the outlet region 100. The outlet 45 opens into outlet region 100. The motion area 101 is arranged radially outwardly of the second wall 85 and is delimited radially outwardly by the housing 46. The motion area 101 ensures that there is sufficient installation space within a housing contour 125 of the housing 46 for eccentric movement of the second wall 85 relative to the stator 15 and the housing 46 without the second wall 85 colliding with the housing 46 or the stator 15.

When the scroll compressor 10 is assembled, e.g. in the heat pump, the inlet 40 introduces the fluid 110 into the inlet region 90. The fluid 110 flows circumferentially along a first outer peripheral side 115 of the first wall 75 toward the compressor region 95. When a compressor torque $M_G$ is applied to the orbiter 20, the orbiter 20 is moved in an eccentric motion about the orbiter axis 55. Thereby, in conjunction with the fixed, stationary stator 15, the working area 105 is moved in the circumferential direction and the working chamber 105 follows the spiral-shaped design of the first wall 75 radially inwardly. As the run length increases, a volume of the respective working area 105 is reduced and the fluid 110 present in the working area 105 is compressed. The compressed fluid 110 is conveyed in the working area 105 to the outlet region 100 and exits the scroll compressor 10 through the outlet 45.

The coupling device 50 has a first coupling unit 60 and a second coupling unit 65. The first coupling unit 60 is arranged on the inside of a housing contour 125 of the housing 46 of the stator 15 and is mechanically connected to the housing 46. In FIG. 2, by way of example, the first coupling unit 60 has a multi-pole permanent magnet 131 that is oriented tangentially to the orbiter axis 55 in its main direction of extension. The multipole permanent magnet 131 has a plurality of north and south poles arranged alternately adjacent to each other in the tangential direction. The first coupling unit 60 is preferably mechanically connected to the housing contour 125 by means of a first interlocking connection 130. The first coupling unit 60 provides a magnetic field 135 through the multi-pole permanent magnet 131, which is schematically indicated by dashed lines in FIG. 2. The magnetic field 135 projects radially inward into the motion area 101.

Radially inwardly opposite to the first coupling unit 60, the second coupling unit 65 is arranged in the motion area 101. The second coupling unit 65 is arranged on a second outer peripheral side 140 of the second wall 85, and is connected to the second outer peripheral side 140 by a second connection 145. Preferably, the second connection 145 can be a bonded and/or an interlocking connection. In particular, the second coupling unit 65 can be fastened to the second outer peripheral side 140 by means of an adhesive bond.

The second coupling unit 65 is made of a ferritic material. Preferably, the second coupling unit 65 has an arrangement comprising a plurality of layers 150 made of a ferritic material such as electrical sheet. The layers 150 are arranged axially adjacent to each other in a stack. Additionally, a retaining means (not shown in FIG. 2) can be provided to connect the plurality of layers 150 of electrical sheet together to ensure secure fastening of the second coupling unit 65 to the second wall 85.

As an alternative to the design of the second coupling unit 65 shown in FIG. 2 with multiple layers 150 of electrical sheet, the second coupling unit 65 can also comprise another permanent magnet having, e.g., the same or similar number of poles as the permanent magnet 131 of the first coupling unit 60. Deviating from this, however, a pole arrangement of the further permanent magnet is opposite to the permanent magnet 131 of the first coupling unit 60. Thus, a south pole of the second coupling unit 65 is arranged facing in the radial direction opposite to, for example, a north pole of the permanent magnet 131.

The first coupling unit 60 has an inner surface 155 on a side facing the second wall 85, exemplarily in FIG. 2, the inner surface 155 is planar. In a radial direction opposite to the inner side 155, the second coupling unit 65 has an outer side 160 on a side facing away from the second wall 85, the outer side 160 being of exemplary planar design. Both the inner surface 155 and the outer surface 160 are oriented tangentially to the orbiter axis 55, by way of example. Furthermore, in the radial direction, the inner side 155 and the outer side 160 are arranged opposite each other. A gap 165 is formed between the inner surface 155 and the outer surface 160. The gap 165 is defined in the radial direction by a distance a between the inner side 155 and the outer side 160. In FIG. 2, the distance a between the inner side 155 and the outer side 160 is maximized.

The gap 165 ensures that the inner surface 155 does not come into contact with the outer surface 160 as the orbiter 20 moves about the orbiter axis 15. Doing so prevents wear, in particular the introduction of metal particles into the fluid 110. Furthermore, it is ensured that despite magnetic coupling, the second coupling unit 65 can be removed from the first coupling unit 60.

In FIG. 2, the orbiter 20 is shown in the 0° position relative to a movement about the orbiter axis 55. In the 0° position, the distance a is maximized. In this case, the second coupling unit 65 is, e.g., arranged outside an effective working range of the magnetic field 135 so that a magnetic coupling between the first coupling unit 60 and the second coupling unit 65 is substantially cancelled.

Figure 3:
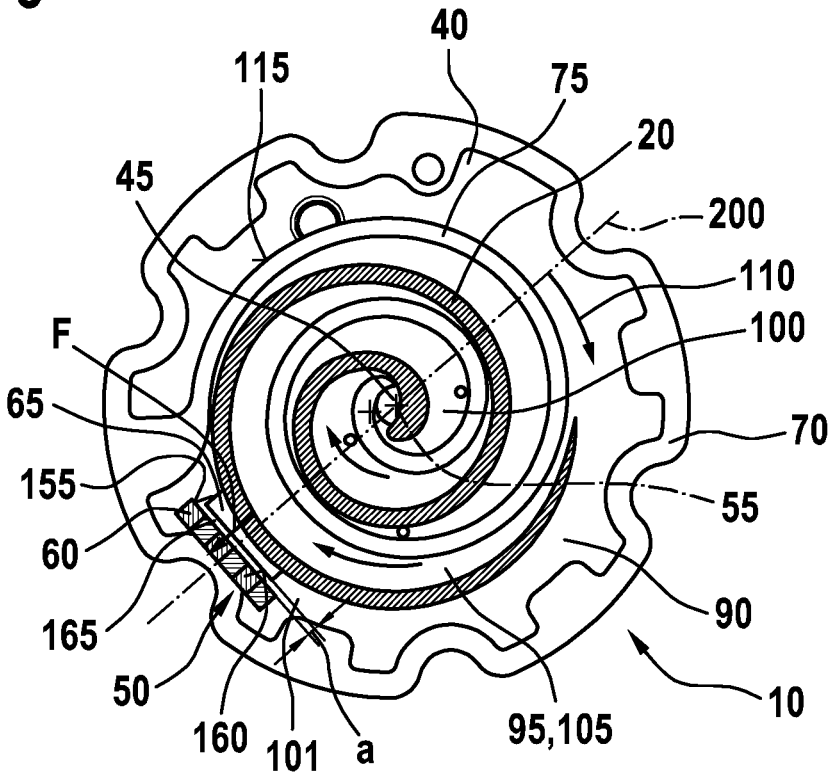
FIG. 3 a sectional view along the sectional plane A-A shown in FIG. 1 through the scroll compressor shown in FIG. 1 in a 180° position.

FIG. 3 shows a sectional view along the sectional plane A-A shown in FIG. 1 through the scroll compressor 10 (shown in FIG. 1 in a 180° position).

In FIG. 3, the orbiter 20 is swung 180° from the view shown in FIG. 2 and is thus in the 180° position. In this position, the distance a between the inner side 155 and the first coupling unit 60 and the outer side 160 of the second coupling unit 65 is minimized. The second coupling unit 65 is located within the working range of the magnetic field 135, so that the first coupling unit 60 is magnetically coupled to the second coupling unit 65. In FIG. 3, the second coupling unit 65 is attracted with a force F by the permanent magnet 131 of the first coupling unit 60.

The multi-layer design of the second coupling unit 65 and the orientation of the layers 150 radially with respect to the orbiter axis 55 has the advantage that eddy currents are avoided when the second coupling unit 65 moves in the magnetic field 135 of the first coupling unit 60, thereby avoiding overheating of the second coupling unit 65 during operation of the scroll compressor 10. Furthermore, in particular if the second joint 145 is designed as a materially bonded joint, this prevents thermal damage to the second joint 145, in particular to a cured adhesive.

In FIGS. 2 and 3, by way of example, the second coupling unit 65 is slimmer in the circumferential direction than the first coupling unit 60. This design has the advantage that the second coupling unit 65 is moved in the working range of the magnetic field 135 for a particularly long time and thus a particularly good magnetic coupling between the first coupling unit 60 and the second coupling unit 65 can be ensured.

Figure 4:
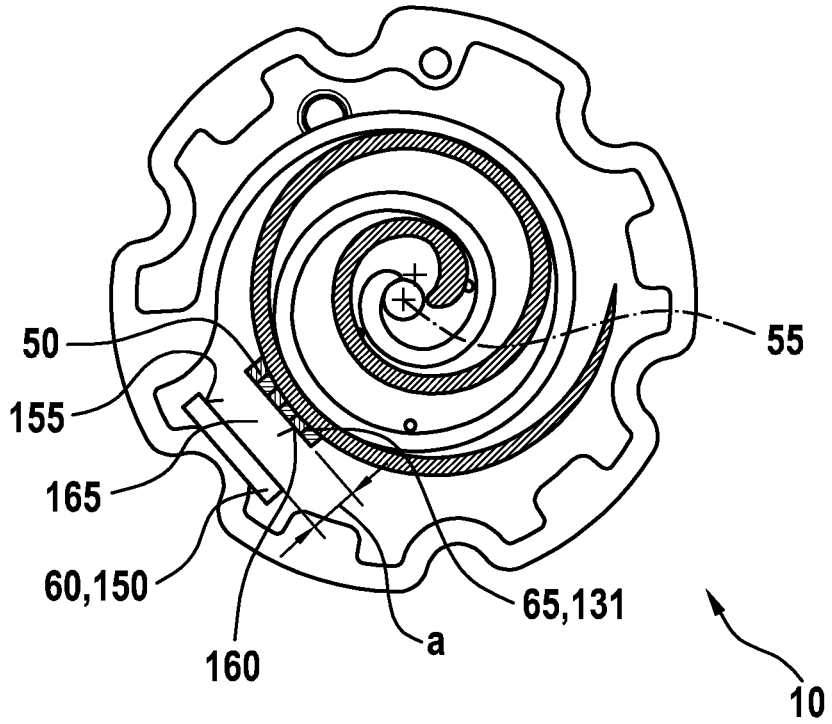
FIG. 4 a sectional view along the sectional plane A-A shown in FIG. 1 through a scroll compressor according to a second embodiment in a 0° position.

FIG. 4 shows a sectional view along the sectional plane A-A shown in FIG. 1 through a scroll compressor 10 according to a second embodiment in the 0° position.

The scroll compressor 10 is shown with the orientation shown in FIG. 2. The scroll compressor 10 is substantially identical in design to the scroll compressor 10 shown in FIGS. 1 to 3 according to the first embodiment. Hereinafter, only the differences of the scroll compressor 10 shown in FIG. 4 according to the second embodiment compared to the first embodiment of the scroll compressor 10 shown in FIGS. 1 to 3 will be explained.

In a departure from FIGS. 1 to 3, the first coupling unit 60 has an arrangement of multiple layers 150 of electrical sheet. The second coupling unit 65 comprises, e.g., the permanent magnet 131. The embodiment shown in FIG. 4 has the advantage that a mass rotating around the orbiter axis 55 is kept particularly low due to the permanent magnet 131 being slim in the radial direction. Due to the reduced mass of the second coupling unit 65 compared to FIGS. 1 to 3, the bearing arrangement 35 is subjected to less mechanical stress when guiding the orbiter 20 about the orbiter axis 55. Doing so can provide a particularly durable scroll compressor 10.

In FIG. 4, to ensure particularly good magnetic coupling between the first coupling unit 60 and the second coupling unit 65, the first coupling unit 60 is formed wider in the radial direction and in the circumferential direction than the first coupling unit 65 in FIGS. 2 and 3.

Figure 5:
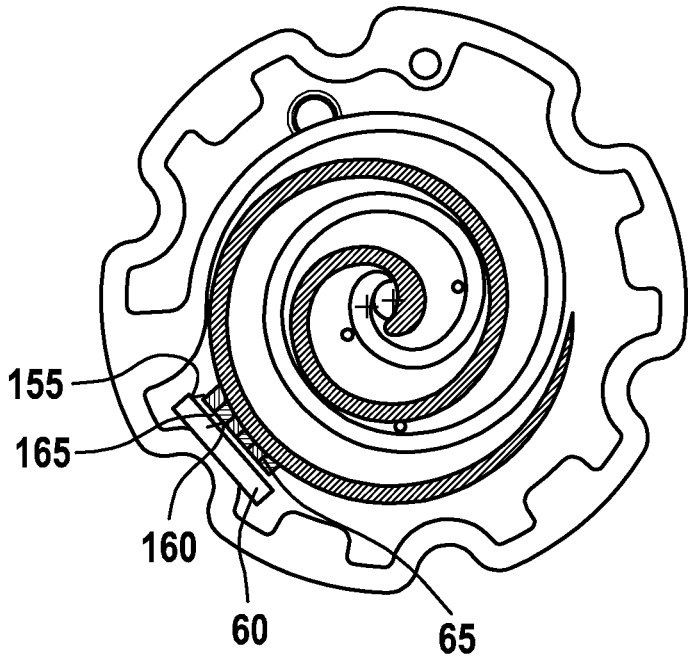
FIG. 5 the sectional view shown in FIG. 4 along the sectional plane A-A shown in FIG. 1 through the scroll compressor according to the second embodiment in a 180° position, and FIG. 6 a torque curve over a swing angle of an orbiter of the scroll compressor about an orbiter axis of the orbiter.

FIG. 5 shows the sectional view shown in FIG. 4 along the sectional plane A-A through the scroll compressor 10 shown in FIG. 1.

In the 180° position, the distance a between the outer side 160 and the inner side 155 of the first coupling unit 60 is minimal. Due to the wide design of the first coupling unit 60 in the circumferential direction, a particularly good magnetic coupling between the first coupling unit 60 and the second coupling unit 65 is achieved.

Figure 6:
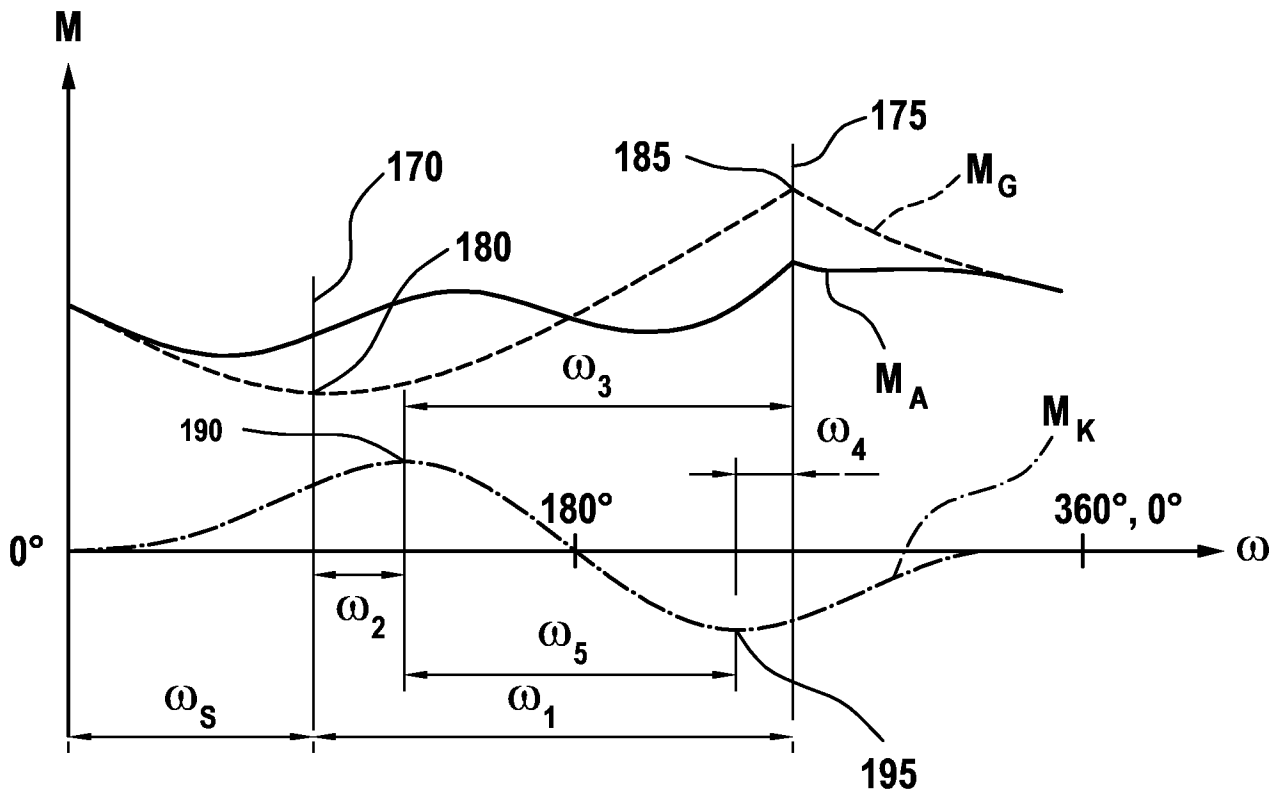

FIG. 6 shows a diagram of torques acting on the orbiter 20 plotted against a swing angle ω of the orbiter 20 about the orbiter axis 55.

The respective torques $M_A$, $M_K$, $M_G$ are plotted starting at the 0° position over the swing angle ω referred to the 0° position. While maintaining a swing direction about the orbiter axis 55, the orbiter 20 is swung from the 0° position through the 180° position toward a 360° position corresponding to the 0° position.

In the graph, a first graph (dashed line) of a compressor torque $M_G$ is plotted versus the swing angle ω, where the compressor torque $M_G$ is applied to the orbiter 20 and used to compress the fluid 110 in the working area 105. Using a solid line, a second graph of a drive torque $M_A$ of the drive motor 25 acting about the orbiter axis 55 is plotted versus the swing angle ω. A dash-dotted line shows a third graph of a coupling torque $M_K$ of the coupling device 50 plotted versus the swing angle ω and acting about the orbiter axis 55. The first graph corresponds to a drive torque of the drive motor of a prior art scroll compressor.

The scroll compressor 10 has a first working point 170 and a second working point 175 as the orbiter 20 swings, starting from the 0° position about the orbiter axis 55. The following is a brief explanation of the working method of the scroll compactor for a working area 105.

By way of example, the orbiter 20 shown in FIGS. 2 through 5 is swung about the orbiter axis 55. At the first working point 170, the fluid 110 is substantially completely expelled from the working area 105 via the outlet 45. At the first working point 170, the compressor torque $M_G$ for moving the orbiter 20 about the orbiter axis 55 reaches a first minimum 180. By way of example, the first working point 170 is reached after movement of the orbiter 20 by a starting swing angle $\omega_S$ from the 0° position.

Between the first working point 170 and the second working point 175, the fluid 110 arranged in a (further) working area 105 is compressed. Between the first working point 170 and the second working point 180, the orbiter 20 is moved through a first swing angle $\omega_1$ about the orbiter axis 55. During compression, the compressor torque $M_G$ increases from the first minimum 180 to the first maximum 185. At the first maximum 185, a pressure of the fluid 110 in the working area 105 reaches a pressure maximum.

At the second working point 175, the working area 105 reaches the outlet region 100. If the orbiter 20 is moved further about the orbiter axis 55 in the swing direction, the compressed fluid 110 is expelled from the working area 105 again via the swing angle ω of the orbiter 20. The orbiter 20 thereby moves past the 0° position until the first working point 170 is reached again. During ejection, the fluid 110 can be introduced radially outwardly of the orbiter 20 between the orbiter 20 and the stator 15 into a further radially outwardly located working area 105 to then compress this fluid 110 again between the first working point 170 and the second working point 175. Due to the alternating compression and expulsion, over the swing angle ω the compressor torque $M_G$ is wavy and fluctuates between the first minimum 180 and the first maximum 185. On the one hand, the fluctuation in the compressor torque $M_G$ puts mechanical stress on the drive motor 25 and the bearing arrangement 35. On the other hand, a current ripple occurs when an attempt is made to electrically compensate for the ripple in the compressor torque $M_G$ by means of a controller.

The coupling device 50 is designed to reduce this ripple of the compressor torque $M_G$ from the point of view of the drive motor, so that the operability of the scroll compressor 10 is ensured and, on the other hand, the drive motor 25 is unloaded.

The magnetic coupling of the first coupling unit 60 causes, on the one hand, the magnetic attraction force F to fluctuate in value due to the swing angle ω with the second coupling unit 65 as the orbiter 20 moves. At the 0° position and the 180° position, a center of the second coupling unit 65 of a main extension direction in the tangential direction is arranged in a plane 200 (see FIGS. 2 and 3) together with a center of the first coupling unit 60 of a main extension direction in the tangential direction. The attractive force F acts radially outward in the plane 200. As a result, the third graph of the coupling torque $M_K$ has a zero crossing in the coupling torque $M_K$ at both the 0° position and the 180° position of the orbiter 20. Between the 0° position and the 180° position, the center of the second coupling unit 65 is arranged outside the plane 200. Due to the attractive force F, the coupling moment $M_K$ thereby acts on the orbiter 20. Due to a decrease in a field strength of the magnetic field 135 with increasing distance a in conjunction with an offset of the center of the second coupling unit 65 as a function of the swing angle ω, the coupling torque $M_K$ exhibits the fluctuating third graph with a second maximum 190 and a second minimum 195 over the swing angle ω. The coupling torque $M_K$ represents a torque for the drive motor 25, which the drive motor 25 has to apply in order to move the orbiter 20 around the orbiter axis 55 without fluid 110, even if the drive motor 25 only has to operate the coupling device 50 (i.e., without compressing the fluid 110).

The coupling device 50 is oriented such that the second maximum 190 and the second minimum 195 of the coupling torque $M_K$ are applied to the orbiter 20 between the first working point 170 and the second working point during compression of the fluid 110 in the working area 105. In other words, the second coupling unit 65 is arranged closer to the first coupling unit 60 during compression of the fluid 110 than during ejection and introduction of the fluid 110 into the working area 105.

The acting torques $M_G$, $M_K$, $M_A$ are explained hereinafter, starting at the first working point 170. The drive torque $M_A$, that the drive motor 25 has to apply to drive the orbiter 20 corresponds to a sum of the compressor torque $M_G$ and the coupling torque $M_K$. The compressor torque $M_G$ is the torque required to move the orbiter 20.

Between the 0° position and the 180° position, the coupling torque $M_K$ acts against the drive torque $M_A$. Between the 180° position and a 360° position corresponding to the 0° position, the coupling torque $M_K$ has a supporting effect on the drive torque $M_A$.

The coupling device 50 is arranged on the orbiter 20 and the housing 46 such that when the first working point 170 is reached, the coupling torque $M_K$ acts against the drive torque $M_A$ and in the direction of the compressor torque $M_G$. Subsequent to the first working point 170, the fluid 110 in the working area 105 is compressed so that the pressure of the fluid 110 increases. The compressor torque $M_G$ required for compression is near the first minimum 180 at this stage of the scroll compressor 10 and is slowly increasing. Between the first working point 170 and the 180° position, i.e., at the start of compression, the coupling torque $M_K$ acts in the direction of the compressor torque $M_G$ and against the drive torque $M_A$. As a result, the drive motor 25 must apply the coupling torque $M_K$ in addition to the compressor torque $M_G$ to move the orbiter 20.

In the 180° position, which is between the first working point 170 and the second working point 175 with respect to the swing angle ω, the distance a between the first coupling unit 60 and the second coupling unit 65 and the attraction force F to the plane 200 is minimal. After passing through the 180° position, the coupling torque $M_K$ acts against the compressor torque $M_G$ so that the drive torque $M_A$ is reduced by the coupling torque $M_K$ and the drive motor 25 is unloaded. The coupling torque $M_K$ supports the drive motor 25 in this phase of compression before the first maximum of the compressor torque $M_G$ is reached.

Preferably, the second coupling unit 65 is arranged on the orbiter 20 such that a second swing angle $\omega_2$ between the first working point 170 and the second maximum 190 during compression is less than a third swing angle $\omega_3$ between the second maximum 190 and the second working point 175. Furthermore, the second minimum 195 can be reached at a fourth swing angle $\omega_4$ before the second working point 175, which can be smaller than the second swing angle $\omega_2$ or the third swing angle $\omega_3$. The first swing angle $\omega_1$ between the first working point 170 and the second working point 175 for compressing the fluid 110 is greater than a fifth swing angle $\omega_5$ between the second maximum 190 and the second minimum 195.

Due to the design of the coupling device 50 described hereinabove, the ripple of the drive torque $M_A$ is greatly reduced and the drive torque $M_A$ is much smoother than the compressor torque $M_G$.

The invention claimed is:

1. A scroll compressor (10), having a stator (15), an orbiter (20) which can be moved about an orbiter axis (55) relative to the stator (15), and a coupling device (50), wherein the stator (15) and the orbiter (20) engage into each other and at least partly delimit at least one working area (105) for compressing a fluid (110) which can be filled into the working area (105), wherein the coupling device (50) has a first coupling unit (60) which is arranged on the stator (15) and a second coupling unit (65) which is arranged on the orbiter (20) opposite the first coupling unit (60), wherein the first coupling unit (60) is magnetically coupled to the second coupling unit (65), and the second coupling unit (65) introduces a coupling torque ($M_K$) which acts about the orbiter axis (55) into the orbiter (20).

2. The scroll compressor (10) according to claim 1, having a drive motor (25) connected to the orbiter (20) in a torque-transmitting manner, wherein the drive motor (25) is designed to provide a drive torque ($M_A$) acting about the orbiter axis (55) for driving the orbiter (20), wherein the drive torque ($M_A$) and the coupling torque ($M_G$) act on the orbiter (20) to form a compressor torque ($M_G$), wherein the orbiter (20) is movable from a first position (0°) via a second position (180°) back to the first position (0°) while maintaining a swing direction, wherein the coupling torque ($M_K$) acts against the drive torque ($M_A$) between the first position (0°) of the orbiter (20) and the second position (180°) of the orbiter (20), wherein, in the second position (180°), the orbiter (20) is swung relative to the first position (0°), wherein between the second position (180°) and the first position (0°) of the orbiter (20) the coupling torque ($M_K$) and the drive torque ($M_A$) are in the same direction.

3. The scroll compressor (10) according to claim 1, wherein a gap (165) is arranged between the first coupling unit (60) and the second coupling unit (65).

4. The scroll compressor (10) according to claim 1, wherein at least one of the two coupling units (60, 65) comprises a two-pole permanent magnet (131) or a multipole permanent magnet (131) for forming the magnetic coupling with the other coupling unit (60, 65).

5. The scroll compressor (10) according to claim 1, wherein the first coupling unit (60) or the second coupling unit (65) has at least one stack of sheets (146) comprising at least two layers (150) made of ferromagnetic material and arranged adjacent to each other in a stack, wherein the layers (150) are arranged adjacent to each other in the axial direction with respect to the orbiter axis (55).

6. The scroll compressor (10) according to claim 1, wherein the stator (15) has a spiral-shaped first wall (75), and the orbiter (20) has a spiral-shaped second wall (85), wherein the first wall (75) and the second wall (85) engage into each other and delimit the working area (105) at least partly, wherein the first coupling unit (60) is attached to a housing (46) of the stator (15), and the second coupling unit (65) is attached to a second outer peripheral side (140) of the second wall (85) of the orbiter (20).

7. The scroll compressor (10) according to claim 1, wherein a center of a maximum extension of the first coupling unit (60) in a tangential direction to the orbiter axis (55) is arranged in a plane (200), wherein the orbiter axis (55) is arranged in the plane (200).

8. A method for operating a scroll compressor (10) according to claim 1, wherein a fluid (110) is introduced into the working area (105), wherein the orbiter (20) is moved about the orbiter axis (55) and the fluid (110) is compressed in the working area (105), wherein the coupling torque ($M_K$) acts on the orbiter (20) through the magnetic coupling between the first coupling unit (60) and the second coupling unit (65).

9. The method according to claim 8, wherein the orbiter (20) is moved from a first position (0°) through a second position (180°) and back to the first position (0°) while maintaining a swing direction about the orbiter axis (55), wherein a drive torque ($M_A$) acting about the orbiter axis (55) is provided to the orbiter (20) to drive the orbiter (20), wherein the drive torque ($M_A$) and the coupling torque ($M_G$) act together on the orbiter (20) to form a compressor torque ($M_G$), wherein the coupling torque ($M_K$) acts against the drive torque ($M_A$) between the first position (0°) of the orbiter (20) and the second position (180°) of the orbiter (20), wherein between the second position (180°) and the first position (0°) of the orbiter (20) the coupling torque ($M_K$) and the drive torque ($M_A$) are in the same direction.

10. The method according to claim 9, wherein between a first working point (170) and a second working point (175) following in time the first working point (170), the fluid (110) is compressed in the working area (105), wherein the coupling torque ($M_K$) acts in opposition to the drive torque ($M_A$) at the first working point (170) at the beginning of the compression of the fluid (110).

11. The method according to claim 9, wherein, between a first working point (170) and a second working point (175) following in time the first working point (170), the fluid (110) is compressed in the working area (105), wherein, at the second working point (175) at one end of the compression of the fluid (110), the coupling torque ($M_K$) acts in the same direction as the drive torque ($M_A$).

* * * * *